US008905852B2

(12) United States Patent
Geylik

(10) Patent No.: US 8,905,852 B2
(45) Date of Patent: Dec. 9, 2014

(54) ROADSIDE PERSONALIZED ENTERTAINMENT SYSTEM AND METHOD

(71) Applicant: Yuri Geylik, Brooklyn, NY (US)

(72) Inventor: Yuri Geylik, Brooklyn, NY (US)

( * ) Notice: Subject to any disclaimer, the term of this patent is extended or adjusted under 35 U.S.C. 154(b) by 99 days.

(21) Appl. No.: 13/854,173

(22) Filed: Apr. 1, 2013

(65) Prior Publication Data

US 2013/0274024 A1 Oct. 17, 2013

Related U.S. Application Data

(60) Provisional application No. 61/622,827, filed on Apr. 11, 2012.

(51) Int. Cl.
*A63G 7/00* (2006.01)
*A63G 31/16* (2006.01)

(52) U.S. Cl.
CPC ..... *A63G 31/16* (2013.01)
USPC ..... 472/43; 472/61

(58) Field of Classification Search
USPC ..... 472/43, 59, 60, 61, 77, 131; 52/6, 7
See application file for complete search history.

(56) References Cited

U.S. PATENT DOCUMENTS

| | | | | |
|---|---|---|---|---|
| 5,499,920 | A * | 3/1996 | Trumbull | 434/69 |
| 6,280,341 | B1 * | 8/2001 | Hayashi | 472/61 |
| 6,665,985 | B1 * | 12/2003 | Hennes | 52/7 |
| 7,905,790 | B2 * | 3/2011 | Schnuckle | 472/43 |
| 8,179,337 | B2 * | 5/2012 | Wilzbach et al. | 345/2.3 |
| 8,578,857 | B2 * | 11/2013 | Crawford et al. | 104/83 |
| 8,795,095 | B2 * | 8/2014 | Stoker | 472/59 |

* cited by examiner

*Primary Examiner* — Kien Nguyen
(74) *Attorney, Agent, or Firm* — Stockwell & Smedley, PSC

(57) ABSTRACT

A roadside personalized entertainment system will be inside a building that may be positioned on major highways or Interstates, or other areas of high vehicular traffic. The system will provide short audio-visual entertainment for travelers while they remain in their vehicle.

33 Claims, 10 Drawing Sheets

ROADSIDE PERSONALIZED ENTERTAINMENT SYSTEM AND METHOD

RELATED APPLICATIONS

This application claims the benefit of the Provisional Patent Application U.S. Ser. No. 61/622,827, filed, Apr. 11, 2012, entitled ROADSIDE PERSONALIZED ENTERTAINMENT SYSTEM AND METHOD, by Yuri Geylik, the disclosure of which is incorporated herein by reference, in its entirety.

BACKGROUND

Field

The present invention relates generally to providing audio/visual entertainment and, more particularly, to doing so near a roadside.

The roadside entertainment systems marketed today do not provide the kind of immersive experience, the convenience, or the functionally that will attract and satisfy today's modern expectations. Most major roadside attractions (with the exception of drive-in movie theaters) require users to exit their vehicles in order to enjoy the experience. There remains a need for roadside entertainment systems to provide a real-life simulation experience that virtually transports users into inter-active destinations. Such a system would enable the users to choose from several available destinations and allow the users to feel as if they are moving through that particular destination.

SUMMARY

In one particular embodiment of the present invention, the roadside personalized entertainment system will be inside a building that may be positioned near major highways or Interstates, or other areas of high vehicular traffic. The system will provide short video entertainment for travelers while they remain in their vehicle. Upon approaching the building, the driver selects from a variety of themes for entertainment by the use of a button menu similar to an ATM machine or vending machine. Then the driver positions the car on a conveyor as instructed. The conveyor can be similar to that of a car wash and include guide rails and a locking mechanism that fixedly attaches to at least two wheels of the vehicle to prevent accidental acceleration during the experience. The vehicle is pulled forward into complete darkness where the presentation begins its display, projected by several projectors on a large two-piece curved screen potentially having three dimensional capabilities. The presentation could be relatively short in duration such as, for example 90 seconds to two minutes; although longer presentations are contemplated as well. After the presentation is finished, the two pieces of the screen can separate to form an exit path in front of the vehicle. Once the egress is formed, the vehicle is transported out of the building via the conveyor. At the end of the conveyor, the wheels will be unlocked so the driver can either leave or re-enter the building for another presentation. Alternatively, while in the building, after the end of one presentation, the driver may be offered an opportunity to view a second presentation prior to exiting the building.

It is understood that other embodiments of the present invention will become readily apparent to those skilled in the art from the following detailed description, wherein it is shown and described only various embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Various aspects of embodiments of the present invention are illustrated by way of example, and not by way of limitation, in the accompanying drawings, wherein.

DETAILED DESCRIPTION

The detailed description set forth below in connection with the appended drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details. In some instances, well known structures and components are shown in block diagram form in order to avoid obscuring the concepts of the invention.

Figure 1:
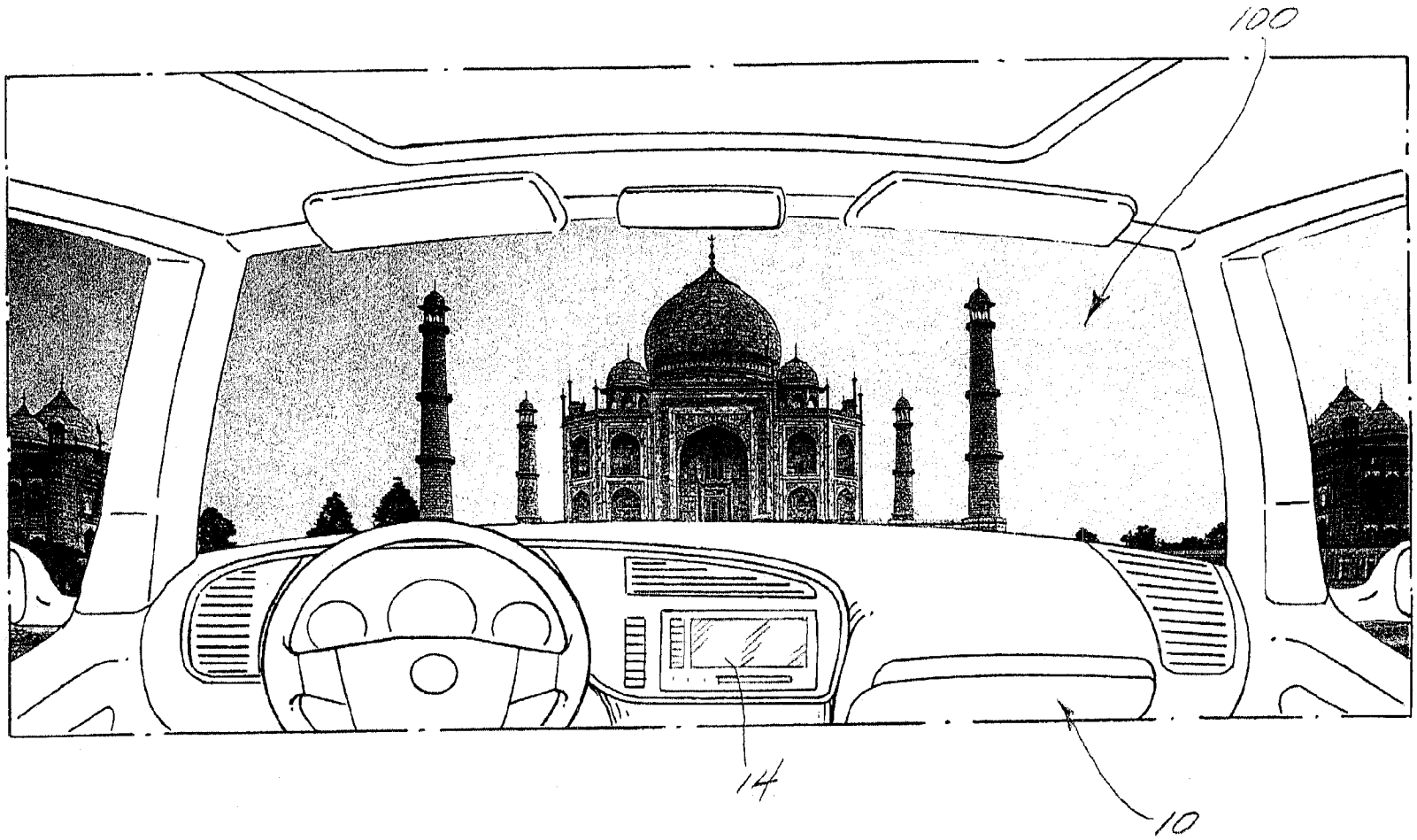
FIG. 1 is a perspective view as seen from the interior of a vehicle showing an example of the audio-visual experience in accordance with the principles of the present invention.

Referring to FIG. 1, one example of an embodiment of the present invention as experienced from the interior of a vehicle 10 is shown. From the inside of the vehicle 10 a driver and any passengers are able to visually view the screen 100 through the vehicle windows. For example, the screen 100 may surround or partially surround the vehicle 10 so that it is visible through the windshield and side windows as well. The visual experience can be in the form of motion video, three-dimensional video or a sequence of still frame images depending on the type of presentation desired. Additional details concerning the video display methods will be described in greater detail below. The video display may be accompanied by an audio presentation as well that is beneficially synchronized with the visual display. The accompanying audio can be in the form of an external speaker system that would have sufficient volume in which the users would easily be able to hear the selected presentation. The content of the audio presentation can include music, narration and sound effects, either individually or in various combinations, depending on the presentation. Further details regarding the audio system will be described in greater detail below.

Figure 2:
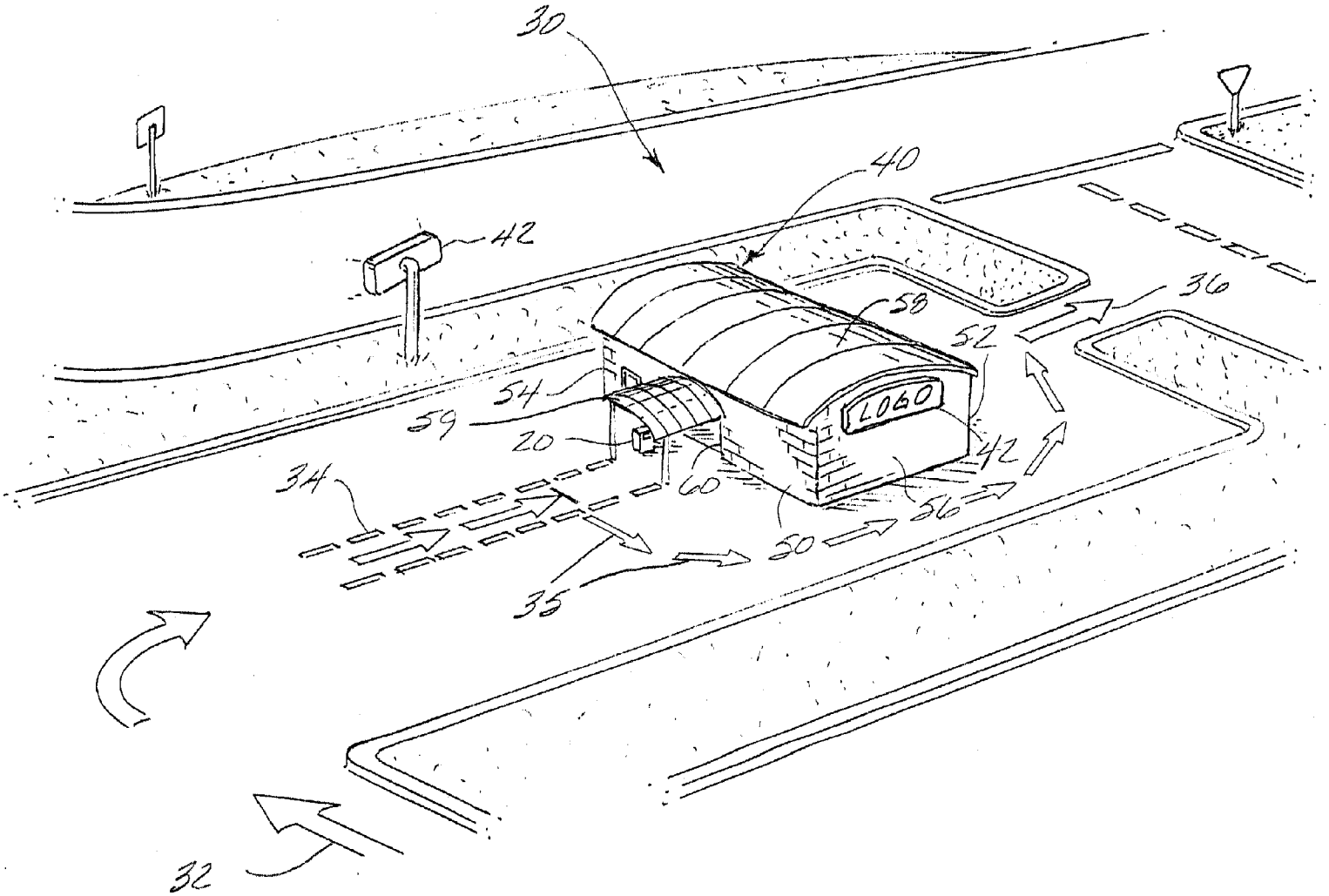
FIG. 2 is a perspective view depicting an environmental location for a building structure that houses various elements of an entertainment system in accordance with the principles of the present invention.
Figure 4:
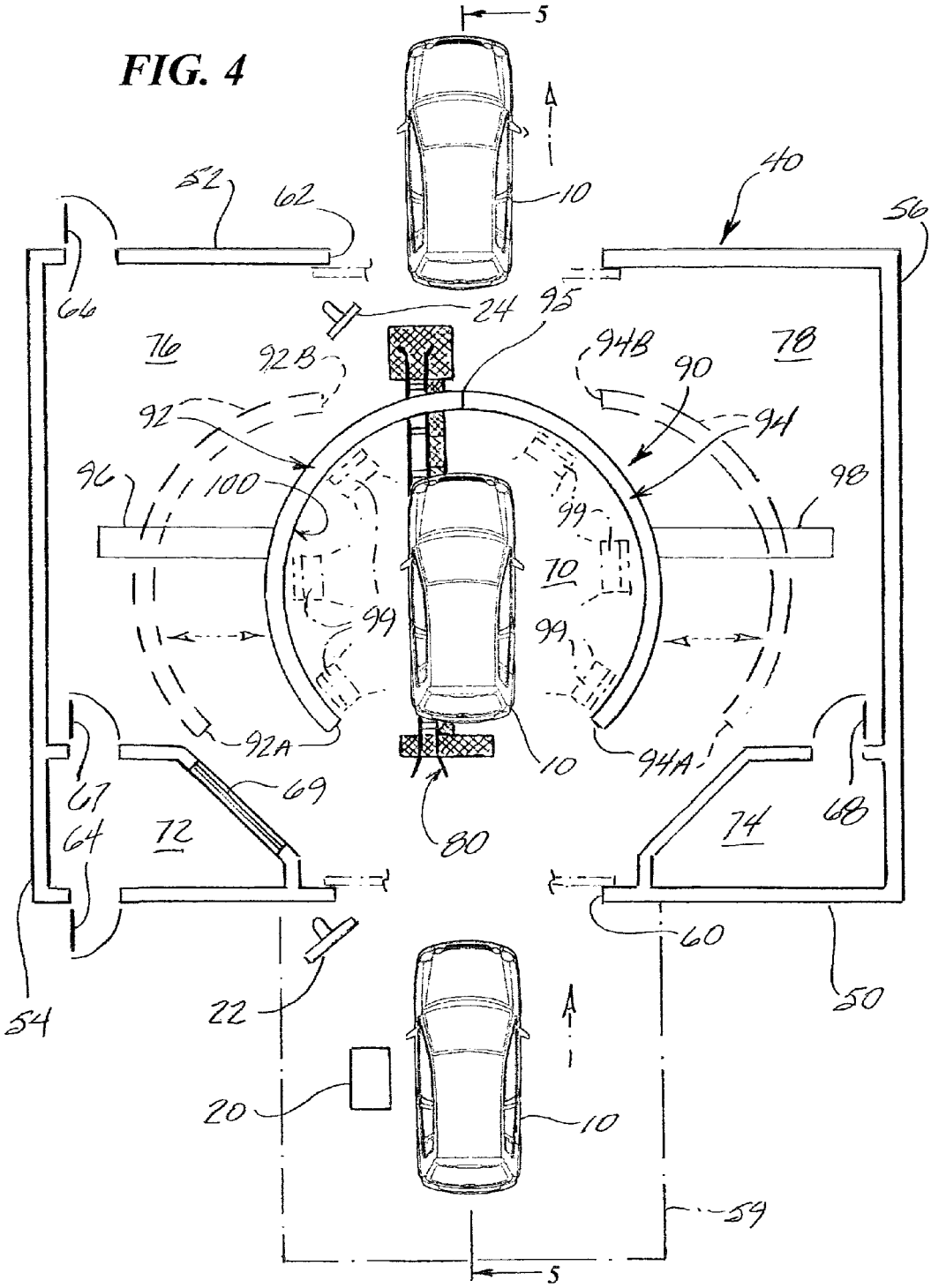
FIG. 4 is a top plan view of the building structure of FIG. 2.
Figure 5:
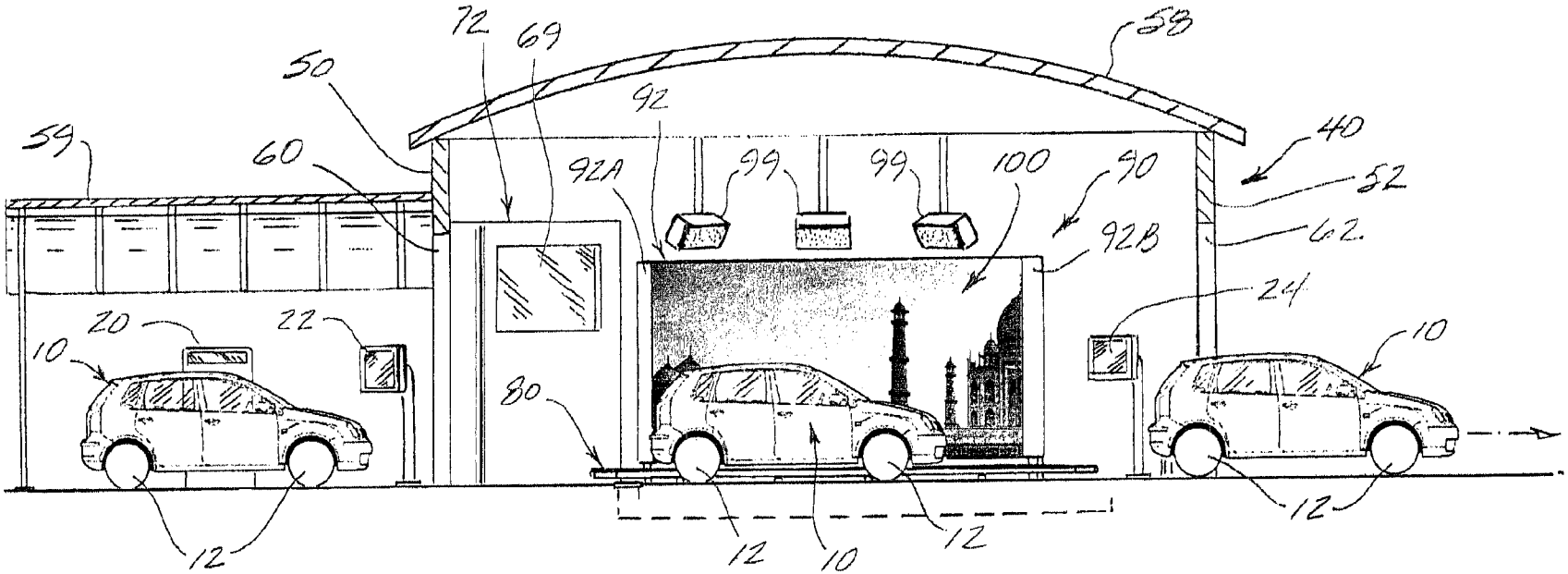
FIG. 5 is a side elevational view in partial cross-section of the building structure taken along section line 5-5 in FIG. 4.
Figure 6A:
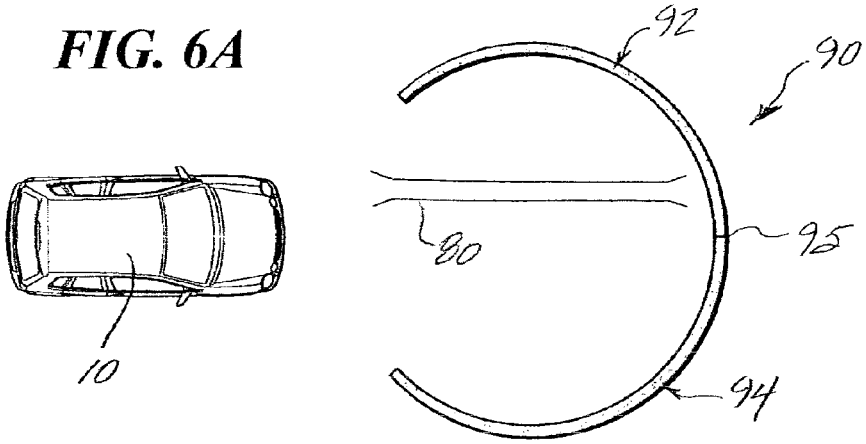
FIGS. 6A-6C are schematic top plan sequence views of one method of providing ingress/egress of a vehicle in accordance with the principles of the present invention.
Figure 6B:
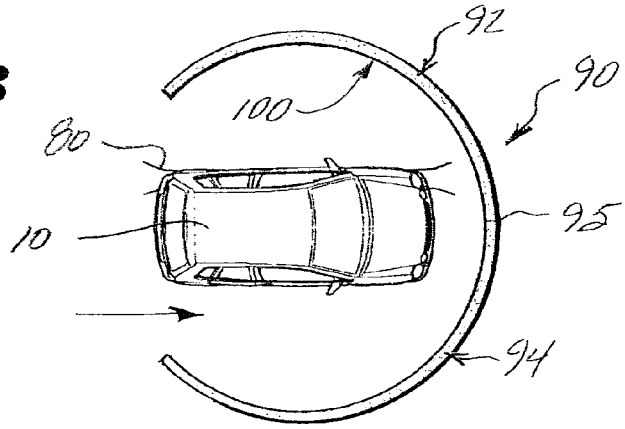
Figure 6C:
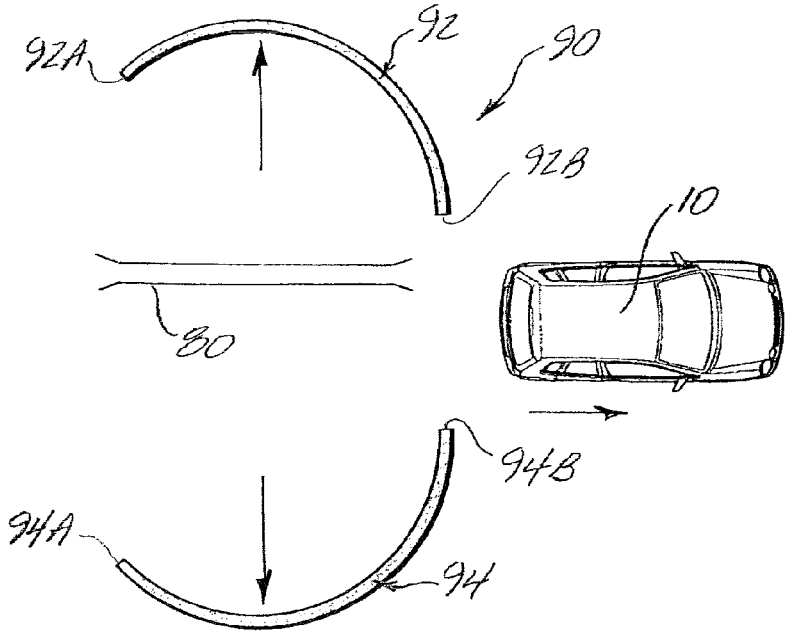

FIG. 2 is an aerial view of a possible location where embodiments of the present invention may beneficially be located. The location illustrated in FIG. 2 is conveniently near a roadway with a relatively high volume of traffic. Such a location increases the number of drivers and vehicles that may conveniently utilize embodiments of the present invention. As shown in FIG. 2, an off-ramp 30, or similar access road, from a highway or interstate road provides access to the building structure 40 containing various elements of an entertainment system in accordance with the principles of the present invention. Various signage 42 can help attract potential customers' attention along with helping direct them to the site. Customers may enter the property via entrance 32, progress to lane markers 34 and approach a user interface 20 or a live attendant. As seen in FIGS. 2, 4 and 5 the building structure 40 may be comprised of a front entrance wall 50, a rear exit wall 52, a right-side wall 54 and a left-side wall 56. A vehicle entrance opening 60 may be located within the wall 50 and a vehicle exit may be located within the wall 52. Roofing 58 covers the building structure 40. Also, to provide protection from the weather or glare from bright sunlight an entrance canopy 59 or similar vestibule can be provided.

The building structure 40 of FIG. 2 is exemplary in nature and one of ordinary skill will recognize that the particular building structure may vary without departing from the scope of the present invention. For example, the building structure 40 may have two (or more) openings 60 so that more than one vehicle can enter the building structure 40 at one time. In such an arrangement, however, additional guiding arrows 35 and other safety precautions could be used to prevent accidents or other unintended mishaps. Additionally, more than one building structure 40 could be constructed at a single location or site. In a particularly high traffic area, doing so would allow more customers to receive service in the same amount of time.

The canopy 59, or another "clearance" bar, may be arranged near the opening 60 in such a way that a driver will be alerted that their vehicle may be too tall to enter the building structure 40. Similarly, the canopy 59 may have its support posts spaced at a distance that will prevent vehicles that are too wide from entering the building structure 40. In the event that a vehicle is determined to be unsuitable to pass through the building structure 40, a side exit 35 may be provided to re-route the vehicle 10 away from the building structure 40 and towards the exit 36. The re-routing measure can occur due to a mechanical condition or improper size of the vehicle 10, suspicious or unlawful behavior of the vehicle occupants, lack of cooperation from users, an emergency situation, etc. Means for determining the above conditions can be in the form of sensors, remote video cameras, as well as an attendant to monitor incoming vehicles and their occupants. Thus, there may be doors across the opening 60 that are only opened once the vehicle 10 and its occupants are approved to enter the building structure 40.

Details concerning the building structure 40 may best be seen with respect to FIGS. 4 and 5. The building structure 40 may also contain a control room 72 and an equipment room 74. The control room 72 can provide accommodations for an attendant as well as the associated controls necessary for the execution of the various elements of embodiments of the present invention. The control room 72 may have a viewing window 69 to allow for observation of the vehicle 10 during a presentation as well as doors 64 and 67 to allow for attendant movement inside and outside of the building structure 40. Equipment room 74 has interior door 68 and may contain associated valves and controls with regards to electrical, hydraulic and other systems required to implement the practice of embodiments of the present invention. Located within rear wall 52 is vehicle exit door opening 62 along with a rear door 66. The overall interior is shown generally with a left side 76 and a right side 78. Within the central portion 70 of building structure 40 is a presentation area 90 where the vehicle 10 and its occupants will experience a personalized multimedia entertainment experience in accordance with the principles of the present invention. The entertainment experience is personalized in that the occupants initially select the subject matter of the multimedia presentation and, also, because they have a private area for viewing and enjoying the presentation. Additional details concerning the presentation area 90 will be described in greater detail below.

As mentioned above, there may be a user interface 20 (or live attendant) that presents a driver of the vehicle with multiple options regarding available presentations. For example, some presentations may be available in 3D at a higher price and there may be selectable audio options for each presentation. For example, the user may prefer to receive the audio portion through their vehicle radio and speakers. However, other users may prefer to receive the audio portion using a speaker system within the building structure 40. As for the subject matter of the various available presentations, they can be presented in a menu-type format where the user selects general categories (e.g., national parks, tourist attractions from around the world, natural wonders, news and information, etc.) Within these general categories, the user can then select a specific presentation for viewing. One of ordinary skill will recognize that such a menu system can be arranged with multiple hierarchical levels and the presentation description can include the length of the presentation and the cost.

After the user submits payment via the interface 20, or an attendant (not shown), and makes a selection of the desired presentation, the driver is prompted by a screen 22 (or similar visual display or audio instructions) to drive the vehicle 10 through entrance 60. Once the vehicle is within the building structure 40 it engages the front end of a conveyor 80. Similar to utilizing a conveyor of a car wash, the driver puts the vehicle's transmission into neutral and the vehicle's tires 12 engage conveyor 80 and is transported into presentation area 90. For example, the conveyor 80 can advance the vehicle 10 to a predetermined location in anticipation of where a viewing screen will be located when the presentation starts. At this point the conveyor 80 can immobilize the vehicle's tires. The driver and passengers then experience the audio-visual presentation. At the conclusion of the experience, the presentation area 90 opens up, the conveyor transports the vehicle 10 towards the exit 62. At this point the vehicle tires 12 can released from the conveyor 80 and the driver is prompted via screen 24 (or similar visual display or audio instructions) to drive through exit 62 thereby exiting the building structure 40.

Conveyor 80 can be comprised of one of various commercially available conveyor systems used in the car wash industry. Such systems are well known and modifications to adapt such systems to the present invention are readily apparent to those skilled in the art.

Figure 3:
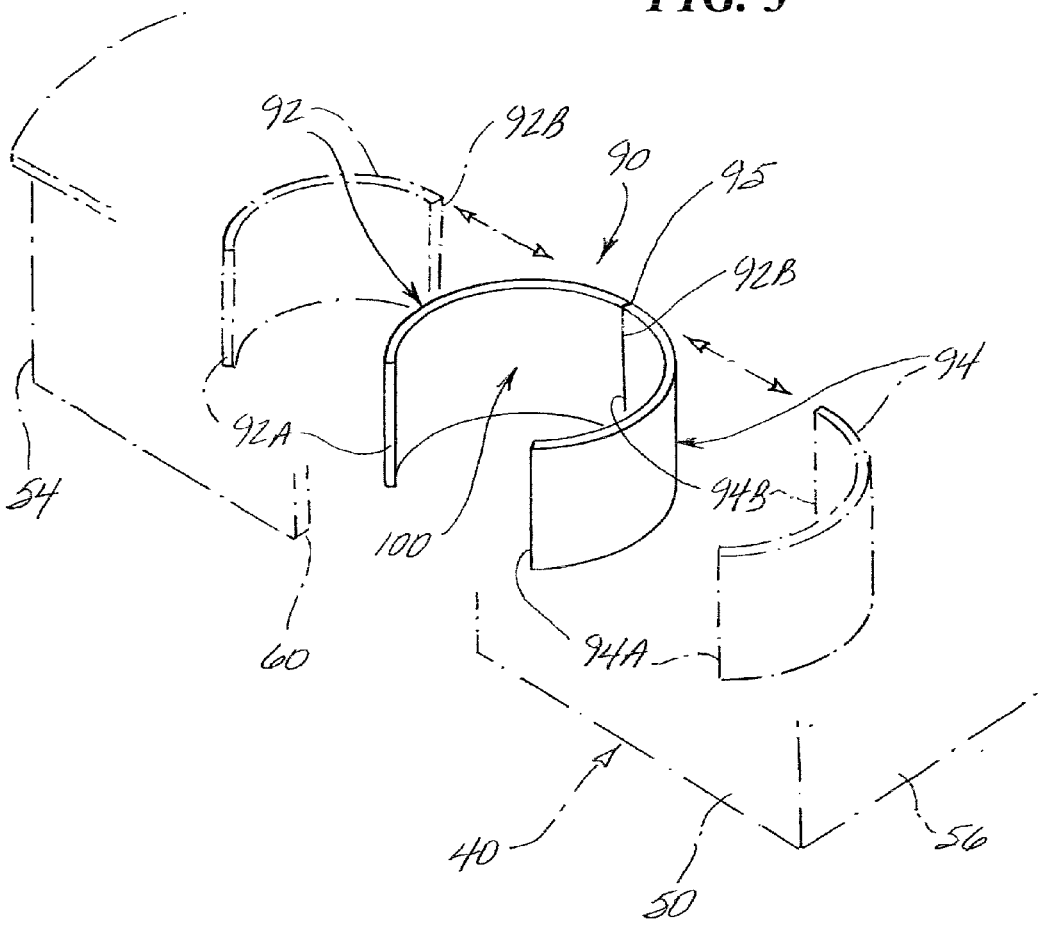
FIG. 3 is a schematic perspective view of a portion of the building structure of FIG. 2 wherein the vehicle enclosure is shown in a first, closed position and a second, open position in broken line-work.

The presentation area 90 will now be described in greater detail with reference to FIGS. 3, 4, 5 and 6A-6C. In the embodiment shown in these figures, two curved screen elements 92 and 94 are capable of moving transversely with respect to the path of conveyor 80 and vehicle 10. This allows for the formation of an enclosure when both screen elements 92 and 94 are, respectively, in one position and an open configuration when the screen elements 92 and 94 are, respectively in another position. As shown in FIGS. 3 and 4 the enclosure is shown in solid line-work and the open configuration is shown in broken line-work. The transverse opening and closing movements are carried out by the actuation of mechanisms 96 and 98, shown schematically in FIG. 4. The mechanisms 96 and 98 can be of a robotic nature, hydraulic, chain driven, belt and pulley system or a number of different methods in order to effect the desired movement. In general, the overall process is for the screen elements 92 and 94 to open and close from an enclosed clam shell configuration in order to allow for the entry and exit of a vehicle 10 within the building structure 40.

As shown in the figures, the screen elements 92 and 94 form an enclosure (in the closed position) that may substantially surround the vehicle 10 but still have a small opening near the rear of the vehicle 10. Such an arrangement may provide the vehicle occupants with the perception that they are immersed in the locale that is the subject of the presentation. To further augment this perception, the screen elements 92 and 94 may be arranged to fully surround the vehicle 10, such that a portion of the presentation may even be viewed out of the rear window of the vehicle 10.

The screen elements 92 and 94 have a respective front proximal surface 92A, 94A and a respective rear distal surface 92B, 94B. When the screen elements 92 and 94 are closed they share a common intersection 95 which occurs when surfaces 92B and 94B come into contact with one another. This closed position defines the enclosed position of presentation area 90 during viewing of the multimedia presentation on screen 100. When screen segments 92 and 94 are opened transversely, the edges 92B and 94B define an opening to allow for the exiting of the vehicle 10. The screen elements 92 and 94 move within regions 76 and 78 respectively within building structure 40.

As for the size of the screen elements 92 and 94, they may appropriately sized to accommodate an average 4-door vehicle that is legally permitted to operate on the roadways. Thus, the height of the screen elements 92 and 94 (as well as their proximity to the vehicle 10 in the closed position) are selected such that occupants of the vehicle are able to enjoy viewing the presentation without seeing the edges of the screen elements 92 and 94. Although not shown, the screen elements 92 and 94 may also be raised and lowered to accommodate vehicles of different height if desired. In this manner a common screen size and position can accommodate both a two-door coupe as well as a large sport-utility vehicle (SUV) such that occupants of either vehicle enjoy the same quality of presentation.

One or more video display screens 100 can be configured in many different ways. One method, as shown in FIGS. 4 and 5, is a series of display projection units 99 which project imagery onto curved screens. Other methods of providing video can be in the form of LCD (liquid crystal display) screens, plasma display screens as well as other screen geometries. Although the drawings depict a curved screen it is possible to implement smaller flat screens to create a similar effect and are within the scope of the present invention. The display screens can be rear projected screen as well. Also, 3D projection techniques can be employed in order to allow the multimedia presentation to be perceived in three dimensions. As is known, there are 3D projection techniques that utilize glasses for the viewers and 3D projection techniques that do not require the use of glasses; embodiments of the present invention contemplate either projection technique within their scope.

Audio can be integrated adjacent the display projection units 99 as seen in FIGS. 4 and 5 or, alternatively, can be located around the periphery of the display screen (not shown). Alternatively, a method of delivering the audio directly to the interior of the vehicle 10 can be accomplished through RF (radio frequency) modulation. In this method the user would be instructed to tune their vehicle's sound system 14 to a specific frequency on the FM band whereby the audio would then play over their vehicle's internal speaker system due to the broadcast of the audio being transmitted via the control room 72. This method would allow the user to tailor the sound to their personal desires.

Additionally, the audio portion of the present invention can be user selected to provide language specific versions, in the event of the presentation being of a narrative nature.

Figure 7:
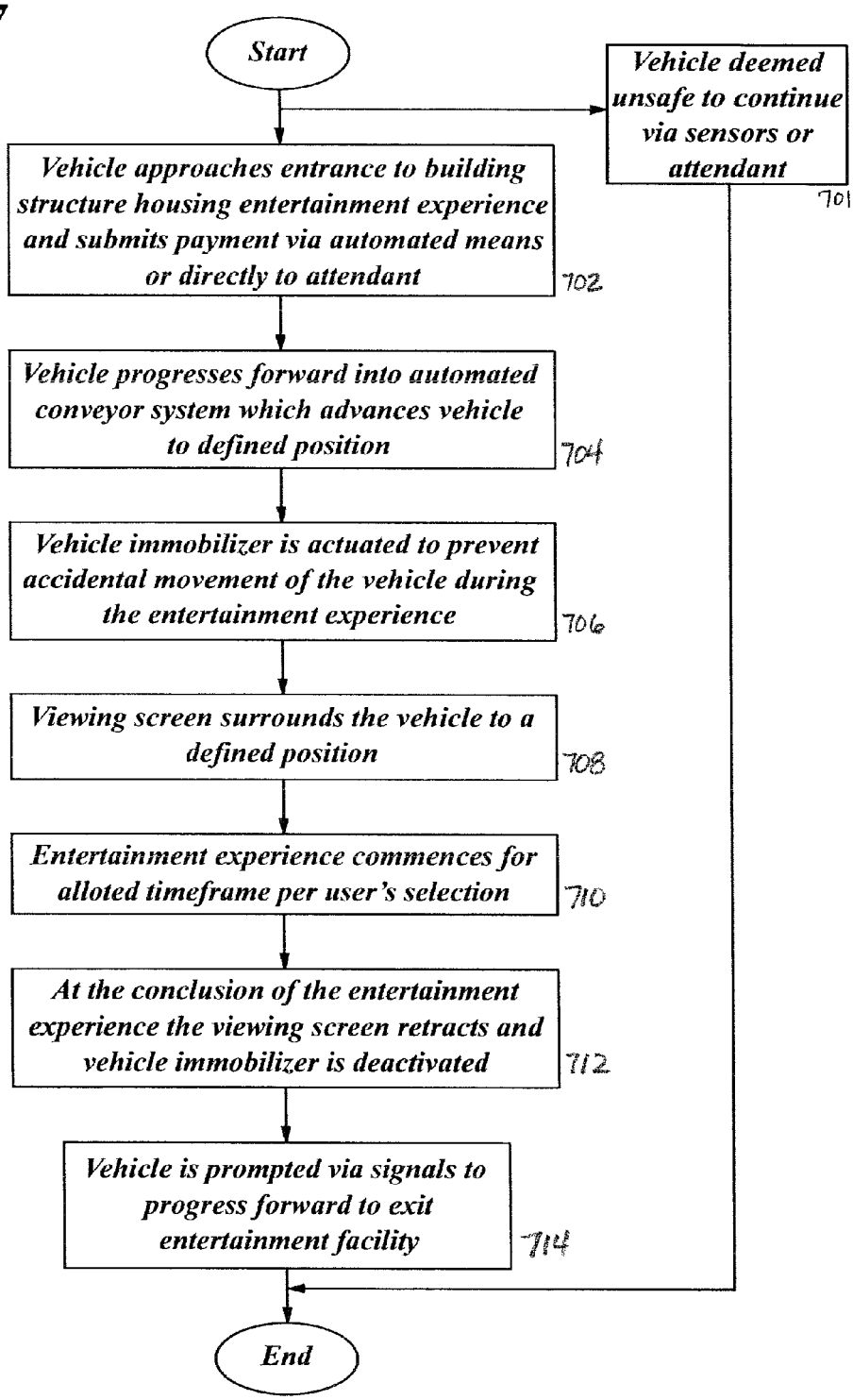
FIG. 7 is a flowchart of an exemplary entertainment process in accordance with the principles of the present invention.

FIG. 7 is a flowchart of an exemplary entertainment process in accordance with the principles of the present invention. Initially, in step 701, the system determines if a vehicle or its occupants are unsafe to continue into the building structure 40. As mentioned above, this determination of the condition of the vehicle or occupants can be accomplished by an attendant or sensors to detect various attributes about the vehicle. If the vehicle is unsafe, then the rest of the process of FIG. 7 is bypassed and the vehicle exits without being provided a presentation.

However, if the vehicle is deemed safe to continue, then in step 702, the vehicle approaches the building structure 40 to engage with the user interface 20 (or an attendant). Using the user interface 20, the driver of the vehicle can identify a particular entertainment presentation they wish to experience. The entertainment presentations may be audio/visual presentations that are stored on computer-readable storage media that is accessible by a computer that controls operation of the entertainment system described herein. Utilizing the user interface, the driver can also tender payment for the entertainment presentation.

Next, in step 704, the driver follows instructions to move the vehicle forward so that it can engage an automatic conveyor system. The vehicle can then be turned off and placed in neutral so that the conveyor advances the vehicle to a predetermined position within the central portion 70 of the building structure 40. Once the vehicle is in position, the conveyor can also operate to immobilize the vehicle, in step 706, so that it cannot inadvertently move during the entertainment presentation.

The system, in accordance with the principles of the present invention, can then, in step 708, position the viewing screens so that they substantially surround the vehicle. Under the control of various computers and sensors, the viewing screens may be placed at a predetermined fixed position for all vehicles. Alternatively, the screen may be controlled so as to be placed at a predetermined distance from the front (or sides) of a vehicle.

In step 710, the system retrieves the entertainment presentation selected by the user. The presentation may include an audio portion that can be rendered in different languages from which the user can select. Once the presentation is retrieved, then both the audio and visual content can be presented to the user through the viewing screens and nearby speakers. As mentioned above, the audio content can alternatively be provided through the vehicle's radio as well.

In step 712, once the entertainment presentation is completed, the system can retract the viewing screens and disable the immobilization of the vehicle. Once this occurs, audio or visual prompts can be provided, in step 714, to guide the driver and the vehicle out of the building structure 40. Before disabling the immobilizer, the conveyor can be used to advance the vehicle relatively close to the exit so as to minimize the chance that a distracted driver would hit any part of the building structure 40.

Figure 8:
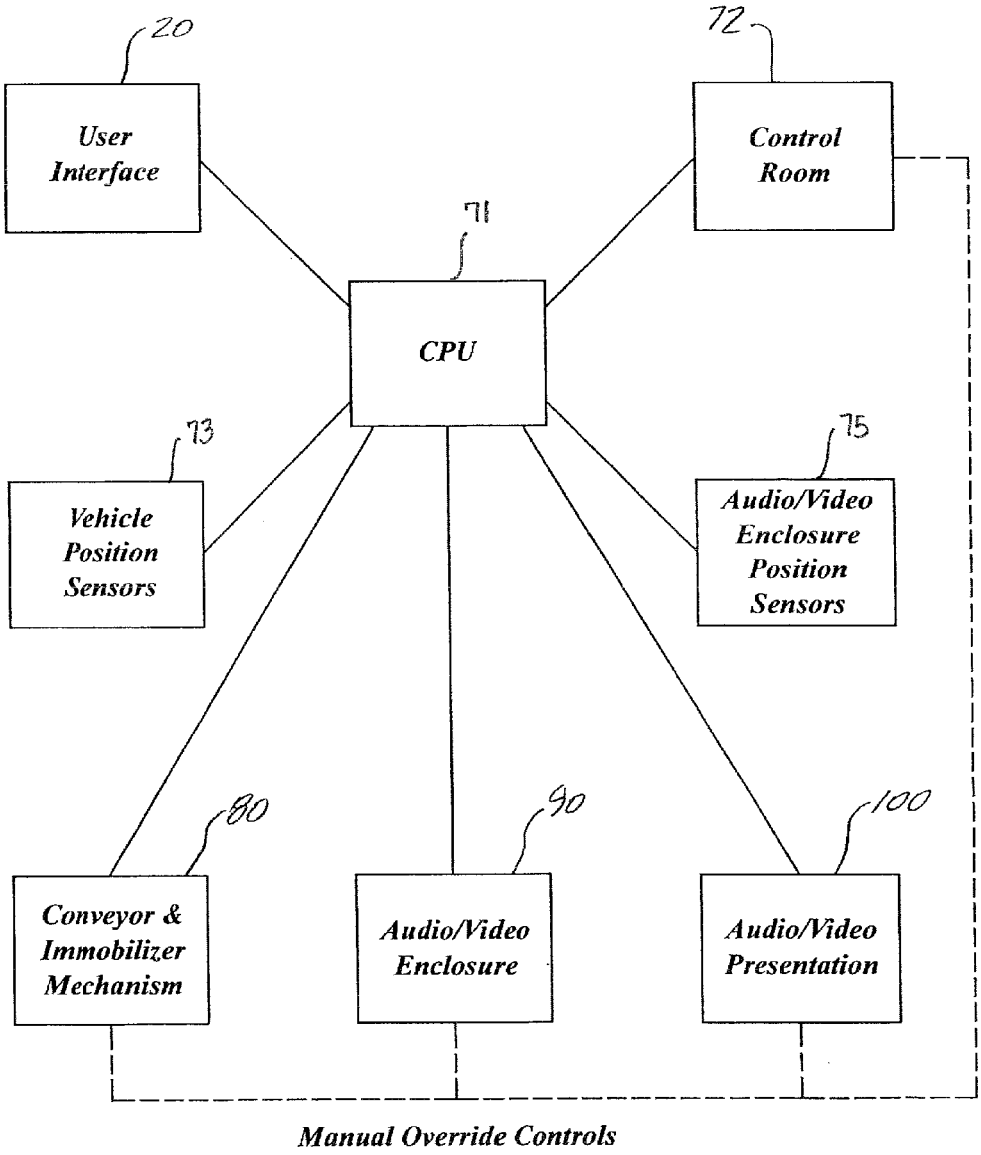
FIG. 8 is a block diagram showing the various controls and interfaces used to execute the method of FIG. 7.

FIG. 8 is a block diagram showing the various controls and interfaces used to execute the method of FIG. 7. In the exemplary embodiment of FIG. 8, a microprocessor 71 can communicate with the user interface 20, the controls for the conveyor 80, the controls for the enclosure 90, the projection controls for the presentation 100 and the control room 72. There may also be sensors 73 and 75 to detect a vehicle's position and to detect the screen element 92 and 94 positions. The microprocessor 71 can be a general-purpose programmable computer configured as a stand-alone computer or networked to other computers. The microprocessor 71 can also be a microcontroller or other special-purpose hardware configured to optimally execute the entertainment system and process described herein. The communication links between the various components of FIG. 8 can be either wired or wireless without departing from the scope of the present invention.

Some aspects of embodiments of the present invention may be embodied as a computer-implemented method or a system. Also, various aspects of the present invention may take the form of an entirely hardware embodiment, an entirely software embodiment (including firmware, resident software, micro-code, etc.). Moreover, embodiments or aspects thereof, such as block(s) illustrated in the diagrams of the figures, may be generally referred to, either individually or collectively as a "circuit," "module" or "system." Furthermore, the various aspects of the present invention may take the form of computer instructions on a computer-usable storage medium having computer-usable program code embodied in the medium.

The software aspects of the present invention may be stored, implemented and/or distributed on any suitable computer usable or computer readable medium(s), including but not limited to, any medium that can contain, store, communicate, propagate or transport the program for use by or in connection with an instruction execution system of a corresponding processing device. The computer program product aspects of the present invention may have computer usable or computer readable program code portions thereof, which are stored together or distributed, either spatially or temporally across one or more devices. A computer-usable or computer-readable medium may comprise, for example, an electronic, magnetic, optical, electromagnetic, infrared, or semiconductor system, apparatus, device, or propagation medium.

More specific examples of the computer usable or computer readable medium comprise for example, an electrical connection having one or more wires, a swappable intermediate storage medium such as floppy drive, tape drive, external hard drive, a portable computer diskette, a hard disk, a random access memory (RAM), a read-only memory (ROM), an erasable programmable read-only memory (EPROM or Flash memory), a portable compact disc read-only memory (CD-ROM) or digital video disk (DVD), an optical fiber or storage device, or a transmission media such as those supporting the Internet or an intranet. The computer-usable or computer-readable medium may also comprise paper or another suitable medium upon which the program is printed, as the program can be electronically captured, for example, via optical scanning of the paper or other medium, then compiled, interpreted, or otherwise processed in a suitable manner, if necessary, and then stored in a computer memory. The computer-usable medium may include a propagated data signal with the computer-usable program code embodied therewith, either in baseband or as part of a carrier wave or a carrier signal. The computer usable program code may also be transmitted using any appropriate medium, including but not limited to the Internet, wireline, optical fiber cable, RF, etc.

Computer program code for carrying out operations of the present invention may be written in any suitable language, including for example, an object oriented programming language such as Java, Smalltalk, C++ or the like. The computer program code for carrying out operations of the present invention may also be written in conventional procedural programming languages, such as the "C" programming language, or in higher or lower level programming languages. The program code may execute entirely on a single processing device, partly on one or more different processing devices, as a stand-alone software package or as part of a larger system, partly on a local processing device and partly on a remote processing device or entirely on the remote processing device or server. In the latter scenario, the remote processing device may be connected to the local processing device through a network such as a local area network (LAN) or a wide area network (WAN), or the connection may be made to an external processing device, for example, through the Internet using an Internet Service Provider.

Figure 9A:
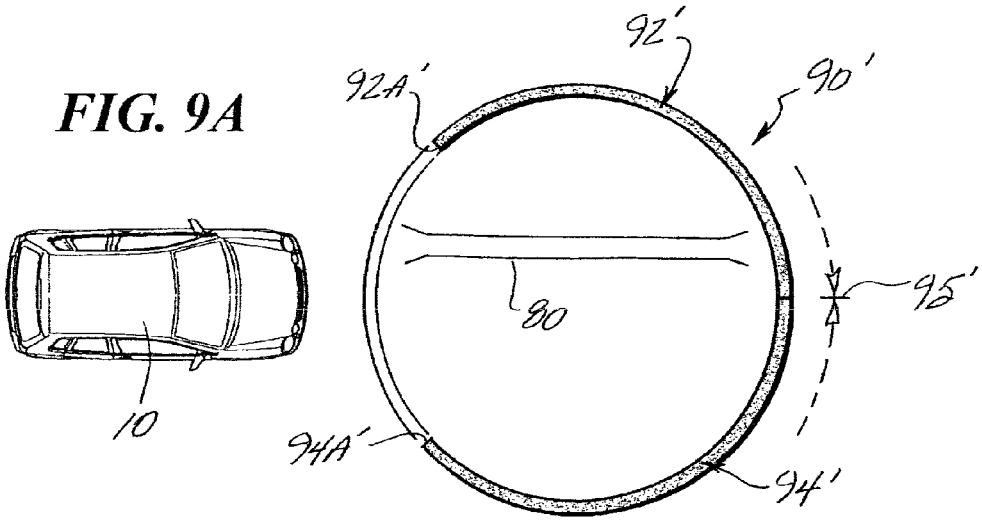
FIGS. 9A-9D are schematic top plan sequence views of an alternate embodiment to provide for the ingress/egress of a vehicle in accordance with the principles of the present invention.
Figure 9B:
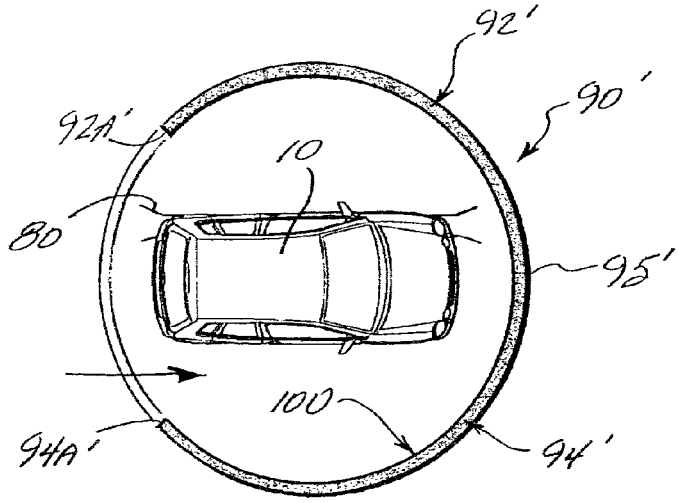
Figure 9C:
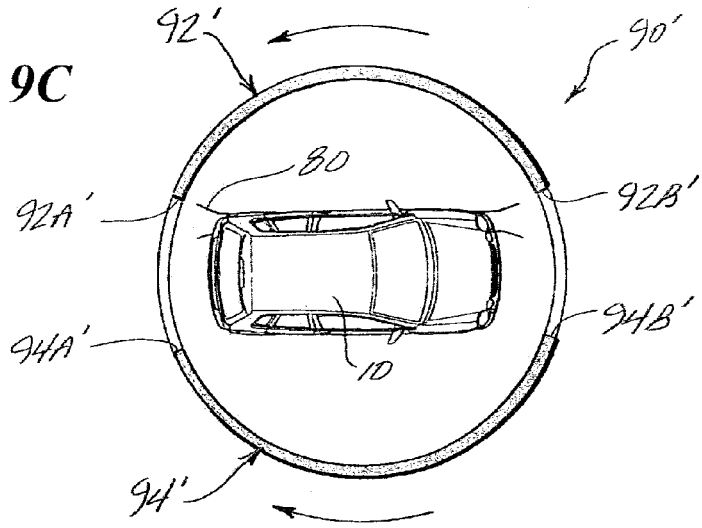
Figure 9D:
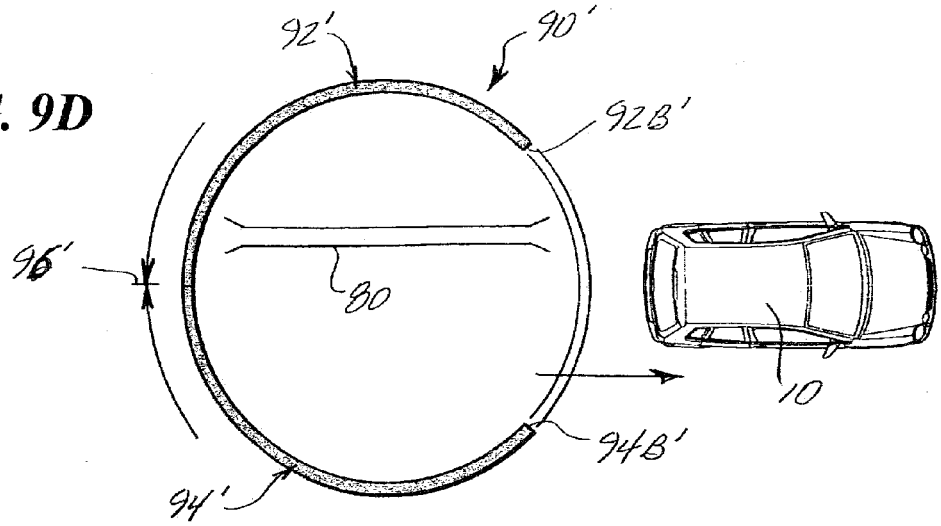

FIGS. 9A through 9D represent an alternate embodiment for the opening and closing of the screen elements comprising enclosure 90'. In this embodiment the screens move rotationally about a center axis. Screen elements 92' and 94' are shown in FIG. 9A in a first position to receive a vehicle 10. In FIG. 9B the vehicle 10 has entered enclosure 90'. FIG. 9C shows the screen elements 92' and 94' partially rotated and FIG. 9D shows the screen elements fully rotated to exit opening position. Screen elements 92' and 94' have a front proximal surface 92A', 94A' and a rear distal surface 92B', 94B' respectively. When the screen elements 92' and 94' are closed in the presentation mode they share a common intersection 95' which occurs when surfaces 92B' and 94B' come into contact with one another. When the screen elements 92' and 94' are opened in the exit mode they share a common intersection 96' which occurs when surfaces 92A' and 94A' come into contact with one another. In this embodiment the requisite space needed for the building structure 40 is smaller allowing for smaller regions 76 and 78 or conversely allowing for a larger presentation area 90 within the same sized building structure 40.

It should be noted that while multiple embodiments have been disclosed that the actual scale and geometry in order to implement the current invention can be accomplished with various means and dimensions in order to achieve a similar result and that the invention is not limited to what is shown and described.

The present invention may be practiced on any form of computer system, including a stand-alone computer or one or more processors participating on a distributed network of computers. Thus, computer systems programmed with instructions embodying the methods disclosed herein, or computer systems programmed to perform various aspects of the present invention and storage or storing media that store computer readable instructions for converting a general purpose computer into a system based upon the various aspects of the present invention disclosed herein, are also considered to be within the scope of the present invention. Once a computer is programmed to implement the various aspects of the present invention, including the methods of use as set out herein, such computer in effect, becomes a special purpose computer particular to the methods and program structures of this invention. The techniques necessary for this are well known to those skilled in the art of computer systems.

Other computer system configurations can also be employed to perform the method of this invention, and to the extent that a particular system configuration is capable of performing the method of this invention, it is equivalent to the representative computer system and within the scope of this invention.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions, or corresponding hardware for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The previous description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but are to be accorded the full scope consistent with each claim's language, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A system comprising:

an enclosed building having a floor, a front wall, a back wall, a right side wall, a left side wall, and a roof that form an enclosed space, wherein the front wall includes an entrance opening and the back wall includes an exit opening;

a conveyor attached to the floor, the conveyor configured to receive at least one wheel of the vehicle and to convey the vehicle to a predetermined location within the enclosed space, wherein the conveyor has a major axis that extends in a direction from the front wall towards the back wall;

a right viewing screen portion within the enclosed space located between the right side wall and the conveyor, wherein the right viewing screen portion is movable between a first position and a second position a left viewing screen portion within the enclosed space located between the second side wall and the conveyor, wherein the left viewing screen portion is movable between a first position and a second position;

wherein when both the right viewing screen portion and the left viewing screen portion are moved to their respective second position they contact one another to form a continuous inside viewing surface that substantially surrounds the predetermined location;

an audio presentation device configured to provide audio content so that the audio content is perceptible at the predetermined location; and a video presentation device configured to display video content on the continuous inside viewing surface.

2. The system of claim 1, wherein when both the right viewing screen portion and the left viewing screen portion are moved to their respective first position they create an opening through which the conveyor can advance the vehicle in a direction towards the exit opening.

3. The system of claim 1, wherein the right viewing screen portion and the left viewing screen portion are movable in a respective direction substantially lateral to the major axis of the conveyor.

4. The system of claim 3:

wherein the right viewing screen portion is movable between the first position proximate the right side wall and the second position proximate the conveyor; and wherein the left viewing screen portion is movable between the first position proximate the left side wall and the second position proximate the conveyor.

5. The system of claim 1, wherein an interface where the right viewing screen portion and the left viewing screen portion contact one another is located between the predetermined location and the back wall.

6. The system of claim 1, wherein the right viewing screen portion and the left viewing screen portion move rotationally around a center axis, wherein the center axis is located proximate to the predetermined location and extends in a direction from the floor to the roof.

7. The system of claim 6, wherein when both the right viewing screen portion and the left viewing screen portion are moved to their respective first position they contact one another at an interface located between the predetermined location and the front wall.

8. The system of claim 6, wherein when both the right viewing screen portion and the left viewing screen portion are moved to their respective second position they contact one another at an interface located between the predetermined location and the back wall.

9. The system of claim 1, further comprising:

a plurality of different audio-visual presentations;

a user interface configured to receive an indication of a desired one of the plurality of audio-visual presentations.

10. The system of claim 9, wherein the desired one of the plurality of audio-visual presentations includes selectable, respective audio content in one of a plurality of different languages and the user interface is further configured to receive a selection that indicates a desired language from among the plurality of different languages for the audio content.

11. The system of claim 9, wherein the user interface is further configured to identify an associated price with the desired one of the plurality of audio-visual presentations and to receive payment commensurate with that price.

12. The system of claim 11, wherein the user interface is located outside the enclosed building and controls access to inside the enclosed building based on receiving the indication and the payment.

13. The system of claim 12, further comprising:

at least one sensor located proximate to the user interface, wherein the at least one sensor is configured to sense a physical attribute of a vehicle whose occupant is engaging the user interface; and wherein the user interface further controls access to inside the enclosed building based on the sensed physical attribute of the vehicle.

14. The system of claim 1, wherein, if an occupied vehicle is positioned at the predetermined location, the continuous inside viewing surface comprises a viewing screen such that the video content is simultaneously viewable though the windshield, at least one left window, and at least one right window of the occupied vehicle.

15. The system of claim 1, wherein the video presentation device comprises a plurality of different projectors configured to project respective portions of the video content onto different regions of the continuous inside viewing surface.

16. The system of claim 15, wherein plurality of different projectors provides a three-dimensional display of the video content.

17. The system of claim 1, wherein the video presentation device comprises a plurality of liquid crystal display screens or a plurality of light emitting diode display screens.

18. The system of claim 17, wherein the video presentation device provides a three-dimensional display of the video content.

19. The system of claim 1, wherein the audio presentation device comprises a plurality of speakers located proximate to the predetermined location.

20. The system of claim 1, wherein the audio presentation device comprises a transmitter that broadcasts the audio content at a particular radio frequency.

21. The system of claim 20, wherein the particular radio frequency is compatible with a conventional FM radio.

22. A method comprising:

providing an enclosed building having a floor, a front wall, a back wall, a right side wall, a left side wall, and a roof that form an enclosed space, wherein the front wall includes an entrance opening and the back wall includes an exit opening;

automatically coupling a conveyor to a vehicle which enters enclosed space through the entrance opening, the conveyor attached to the floor, the conveyor configured to receive at least one wheel of a vehicle, wherein the conveyor has a major axis that extends in a direction from the front wall towards the back wall conveying the vehicle using the conveyor to a predetermined location within the enclosed space;

providing a right viewing screen portion within the enclosed space located between the right side wall and the conveyor, wherein the right viewing screen portion is movable between a first position and a second position;

providing a left viewing screen portion within the enclosed space located between the second side wall and the conveyor, wherein the left viewing screen portion is movable between a first position and a second position;

wherein when both the right viewing screen portion and the left viewing screen portion are moved to their respective second position they contact one another to form a continuous inside viewing surface that substantially surrounds the predetermined location;

presenting audio content so that the audio content is perceptible at the predetermined location; and displaying video content on the continuous inside viewing surface.

23. The method of claim 22, wherein when both the right viewing screen portion and the left viewing screen portion are moved to their respective first position they create an opening through which the conveyor can advance the vehicle in a direction towards the exit opening.

24. The method of claim 22, wherein the right viewing screen portion and the left viewing screen portion are movable in a respective direction substantially lateral to the major axis of the conveyor.

25. The method of claim 24:

wherein the right viewing screen portion is movable between the first position proximate the right side wall and the second position proximate the conveyor; and wherein the left viewing screen portion is movable between the first position proximate the left side wall and the second position proximate the conveyor.

26. The method of claim 22, wherein an interface where the right viewing screen portion and the left viewing screen portion contact one another is located between the predetermined location and the back wall.

27. The method of claim 22, wherein the right viewing screen portion and the left viewing screen portion move rotationally around a center axis, wherein the center axis is located proximate to the predetermined location and extends in a direction from the floor to the roof.

28. The method of claim 27, wherein when both the right viewing screen portion and the left viewing screen portion are moved to their respective first position they contact one another at an interface located between the predetermined location and the front wall.

29. The method of claim 27, wherein when both the right viewing screen portion and the left viewing screen portion are moved to their respective second position they contact one another at an interface located between the predetermined location and the back wall.

30. The method of claim 22, further comprising:

storing a plurality of different audio-visual presentations;

receiving an indication of a desired one of the plurality of audio-visual presentations; and retrieving respective audio content and video content associated with the desired one of the plurality of audio-visual presentations.

31. The method of claim 30, wherein the desired one of the plurality of audio-visual presentations includes selectable, respective audio content in one of a plurality of different languages and the method further comprises:

receiving a selection that indicates a desired language from among the plurality of different languages for the audio content.

32. The method of claim 30, further comprising:

identifying an associated price with the desired one of the plurality of audio-visual presentations; and receiving payment commensurate with that price.

33. The method of claim 32, further comprising:

controlling access to inside the enclosed building based on receiving the indication and the payment.

* * * * *